United States Patent [19]

Rehkopf et al.

[11] Patent Number: 4,940,440

[45] Date of Patent: Jul. 10, 1990

[54] WEAK BEAM SCANNING OF CATHODE RAY TUBES

[75] Inventors: Charles H. Rehkopf, Seneca Falls, N.Y.; Franklin G. Reigel, Ottawa, Ohio; Samuel S. Chung, Liverpool, N.Y.

[73] Assignee: North American Philips Corporation, New York, N.Y.

[21] Appl. No.: 137,041

[22] Filed: Dec. 23, 1987

Related U.S. Application Data

[63] Continuation-in-part of Ser. No. 20,049, Feb. 27, 1987, abandoned.

[51] Int. Cl.[5] ..... H01J 9/44

[52] U.S. Cl. ..... 445/5; 445/6

[58] Field of Search ..... 445/6, 5

[56] References Cited

U.S. PATENT DOCUMENTS 4,395,243 7/1983 Toyama et al. ..... 445/6

*Primary Examiner*—Kurt Rowan

*Attorney, Agent, or Firm*—John C. Fox

[57] ABSTRACT

In the processing of cathode ray tubes, both the incidence of dark center cathode and residual gas can be reduced by including the step of scanning the mask and screen of the tube with a weak, defocused electron beam, carried out after getter flashing and preferably prior to aging.

13 Claims, 3 Drawing Sheets

WEAK BEAM SCANNING OF CATHODE RAY TUBES

CROSS REFERENCE TO RELATED APPLICATION

This application is a continuation-in-part of Ser. No. 020,049, filed Feb. 27, 1987, now abandoned. Allowed patent application Ser. No. 145,637, filed Jan. 11, 1988, relates to an improved aging process for cathode ray tubes.

BACKGROUND OF THE INVENTION

This invention relates to the processing of cathode ray tubes, and more particularly relates to an improved process in which color tubes for color television are scanned with a weak defocused electron beam.

In the manufacture of color cathode ray tubes for color television and other display applications, various tube processing steps are carried out to insure an acceptable life of reliable operation in the field. This processing begins after assembly of the tube components, and includes: exhausting and baking the tube to evacuate the envelope and outgas the tube and components; flashing a getter onto the internal surfaces of the tube and components to provide continuous gettering of residual contaminants which are outgassed during tube operation; activating the cathodes of the electron gun by heating to promote the formation of low work function species in the emission layer; aging the cathode and lower grid elements of the gun to maintain cathode activation; and high voltage conditioning of the electron gun to remove particles and projections which could lead to interelectrode arcing.

Tube processing is sometimes concluded with a final step of raster scanning the mask and screen of the tube with a focused electron beam, produced using normal gun voltages to simulate operating conditions, for a time sufficient to outgas the scanned surfaces and allow the tube to stabilize prior to shipment to the customer.

It has also been proposed to substitute less precise scanning of a defocused beam for the above raster scanning, in order to avoid the need for sophisticated deflection yokes and associated circuitry. However, raster scanning with a focused beam has the additional advantage of enabling visual inspection for blocked mask apertures.

The rate of outgassing during exhausting and baking is time and temperature dependent, and the throughput demands of the manufacturing process as well as the limited thermal stability of certain tube components make complete outgassing during this stage impractical. Thus, some residual gas and gas-producing contaminants, such as hydrocarbons, remain in the tube after sealing of the exhaust tubulation.

Getter flashing usually introduces additional hydrocarbon contaminants into the tube. These hydrocarbons cannot be effectively adsorbed by the non-bakable barium getters widely used in color television picture tubes. However, during subsequent aging, at least some of these hydrocarbons are dissociated into getterable components, resulting in the reduction of residual gas in the tube to acceptable levels.

It has been found that aging is most effective when the focusing electrode adjacent the lower grid electrodes is included in the aging process, and such aging is referred to herein as "G-3 aging", after the conventional designation of this electrode.

Unfortunately, when the focusing electrode is included in aging, a condition known as "dark center cathode" can result, which by analysis has been found to be due to a carbon deposit in the center of the emissive layer of the cathode. Surprisingly, this deposit does not materially reduce cathode emission. However, it does restrict emission to the area of the perimeter of the emissive layer, resulting in a hollow beam which interferes with proper focusing and image resolution at the screen.

In allowed U.S. patent application Ser. No. 145,637, filed Jan. 11, 1988, and assigned to the present assignee, the cause of dark center cathodes was postulated to be due to the successively higher voltages which are impressed on the G1, G2 and G3 electrodes during aging, causing the electrons emitted from the cathodes to be focused into an electron beam which dissociates residual hydrocarbons present in the tube after exhausting, baking and getter flashing, and results in the formation of a beam of positive carbon ions which travel in the reverse direction from the electron beam and are deposited on the cathode.

It was shown that reducing the potential of the G3 electrode during aging to a critical level above a threshold needed for effective aging, but sufficiently below the potential of the G2 grid to create a potential barrier and prevent the positive beam from reaching the cathode, significantly reduces the incidence of dark center cathodes while substantially retaining the benefits of G3 aging.

However, even with the above G3 aging, some incidence of dark center cathode can still occur, and residual gas levels can still be higher than desired.

Accordingly, it is a principal object of the present invention to reduce hydrocarbons present in a color cathode ray tube after getter flashing, without depositing carbon on the cathodes.

It is another object of the invention to reduce hydrocarbons below the level obtained by the improved G-3 aging process described above, without depositing carbon on the cathodes.

Still other objects of the invention are to reduce residual gases present after getter flashing, and to reduce these residual gases below the level obtained by the improved G-3 aging process.

SUMMARY OF THE INVENTION

In accordance with the invention, the processing of a color cathode ray tube is improved by scanning the mask and screen of the tube with a weak, defocused electron beam after the tube has been evacuated, baked, sealed and getter flashed, and preferably after cathode activation, but prior to aging to dissociate hydrocarbons and deposit carbon on tube surfaces away from the cathode. Gaseous products of the dissociation, as well as any species outgassed from the scanned surfaces, are permanently gettered to prevent later outgassing.

The beam is produced by applying predetermined voltages to the cathode heaters and selected electrodes of the tube's electron gun, to cause electron emission from the cathodes, and radiation of a weak, defocused electron beam from the gun, the beam having an energy substantially lower than that obtained with normal operating voltages, but sufficient to achieve substantial dissociation of hydrocarbons.

Suitable beam energies are achieved in accordance with the invention using anode potentials which are from about 15 to 60 percent of the anode potential during normal tube operation.

Scanning may take place by impressing a fluctuating magnetic field on the beam to cause deflection of the beam in response to the field. Such a field may be produced by impressing differing A.C. signals on at least two electromagnets located outside the tube's envelope.

Such weak beam scanning is preferably practiced in combination with, and prior to aging, which aging preferably includes at least the G3 focusing electrode adjacent the G2 grid electrode. Such G3 aging is preferably the improved G3 aging described above, in which the G3 grid voltage is smaller than the G2 grid voltage.

DESCRIPTION OF THE PREFERRED EMBODIMENTS

Figure 1:
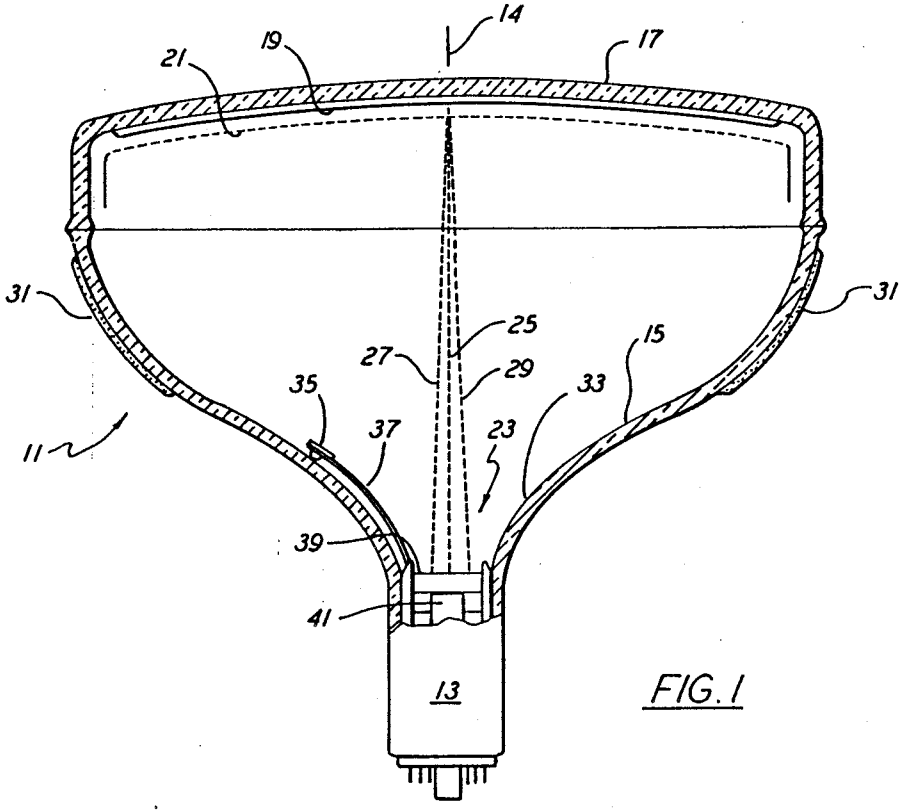
FIG. 1 is a partial cross-section view of a sealed and getter flashed cathode ray tube to be processed in accordance with the invention.

With reference to the drawings, FIG. 1 is a sectioned view showing the essential elements of a plural beam in-line color cathode ray tube 11 employing the invention. Cathode ray tube 11 is oriented to have a central longitudinal axis 14 and X and Y axes normal to axis 14. The encompassing tube envelope is a glass structure comprised of a hermetically sealed integration of neck 13, funnel 15 and viewing panel 17 portions. Disposed on the interior surface of the viewing panel is a patterned cathodoluminescent screen 19 of stripes or dots of color-emitting phosphor materials. A multi-opening structure 21, in this instance an aperture mask, is positioned within the viewing panel in spaced relationship to the patterned screen 19. Encompassed within the neck portion 13 of the envelope is a unitized plural-beam in-line electron gun assembly 23, from which emanate three electron beams, a center beam 25 and two side beams 27 and 29 in a common in-line plane. These beams are directed and focused to traverse the aperture mask 21 and converge at screen 19 to excite the color-emitting phosphors.

The exterior surface of the tube has an electrically conductive coating 31, applied to the forward region of the funnel 15, and maintained at ground potential during tube usage.

The plural gun assembly 23 is positioned within the neck portion 13 in a manner whereby the three in-line beams 27, 25, and 29 are in a common horizontal "in-line" plane substantially coincident with the X axis of the tube. The gun assembly is a longitudinal construction of a plurality of spatially-related unitized in-line apertured electrode members. The electrodes are positioned in a spaced, sequential arrangement forward of individual electron emitting cathode elements to form, focus and accelerate each of the individual electron beams. The assembly is forwardly terminated by a convergence cup 39, and the whole structure is integrated by at least two oppositely disposed insulative multiform members, only one of which, 41, is shown. A getter container 35 is supported by wand 37 attached to convergence cup 39. A thin layer of getter material, not shown, flashed from container 35 by induction heating, covers portions of the inner surface of the envelope, mask and other tube components.

In accordance with the invention, hydrocarbons inside the tube envelope are dissociated into carbon and getterable species, and the carbon is buried on tube surfaces away from the cathode, by scanning the mask 21 and screen 19 of tube 11 with a weak, defocused electron beam obtained by impressing predetermined potentials on the cathode heaters and selected electrodes of the gun assembly 23.

The potential on the cathode heater filaments, $E_f$, is preferably moderately above normal operating potential, in order to maintain the cathodes at a moderately elevated temperature and thus discourage gas absorption by the cathode structures. Voltages comparable to those encountered during aging, that is, 7 to 10 volts, are acceptable.

The anode potential should be sufficient to obtain a beam energy which will achieve dissociation of hydrocarbons, and preferably some outgassing of scanned surfaces, but below that at which arcing and cathode poisoning by ion burial might occur. The risk and/or extent of cathode poisoning decreases with decreasing beam energies, but the residual gas increases with decreasing beam energies. Such potential must be well below the 25–27KV operating potentials, typical of color cathode ray tubes. Based on these considerations, anode potentials within the range of about 4 to 15KV are satisfactory, below which residual gas is not reduced substantially, and above which the improvement in residual gas reduction is outweighed by accompanying significant decrease in cathode emission. The potential on the remaining electrodes should be within a range to avoid either over- or under-focusing, which would result in grid interception and consequent neck glow problems, generally between about 200 and 500 volts. The G1 grid electrode is usually grounded with the cathodes during scanning, to maintain a simple zero bias condition.

Figure 2:
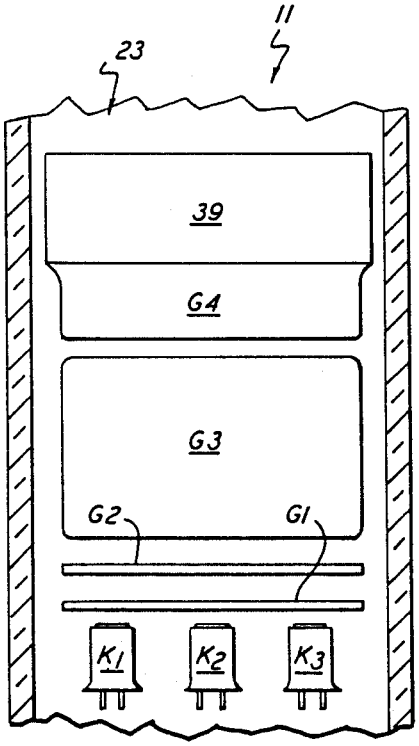
FIG. 2 is a partial cross-section of the neck portion of the cathode ray tube of FIG. 1, showing the cathode and grid elements of a bipotential electron gun to be processed in accordance with the invention.
Figure 3:
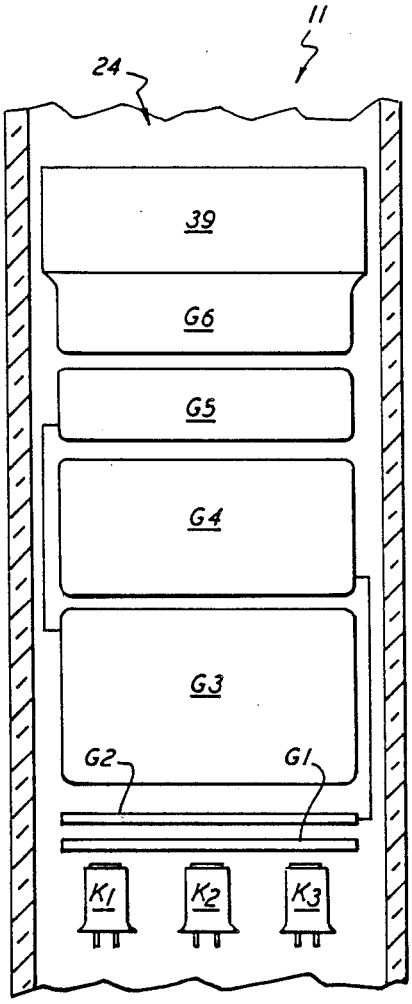
FIG. 3 is a view similar to that of FIG. 2, showing the elements of a quadripotential electron gun to be processed in accordance with the invention.

FIGS. 2 and 3 show two general types of gun assemblies currently in widespread use which may be processed in accordance with the teachings of the invention. In FIG. 2, a unitized bi-potential electron gun assembly is shown which comprises a plurality of unitized in-line apertured electrode members sequentially positioned forward of individual cathode elements, $K_1$, $K_2$, $K_3$. The bi-potential electrode arrangement includes an initial beam forming electrode (G1), an initial beam accelerating electrode (G2), a main focusing electrode (G3) having a longitudinal dimension defined by rearward and forward apertured ends and a final accelerating electrode or anode (G4).

In FIG. 3, a unitized quadripotential in-line gun assembly is shown, having a plurality of electrodes positioned forward of individual cathode elements $K_1$, $K_2$, $K_3$, including an initial beam forming electrode (G1), an initial beam accelerating electrode (G2), a first high focusing electrode (G3), a low focusing electrode (G4) electrically connected to the (G2) electrode, a second high focusing electrode (G5) electrically connected to the (G3) electrode, and a final accelerating electrode or anode (G6). Each of the (G3), (G4) and (G5) electrodes has a longitudinal dimension defined by forward and rearward apertured ends.

Figure 4:
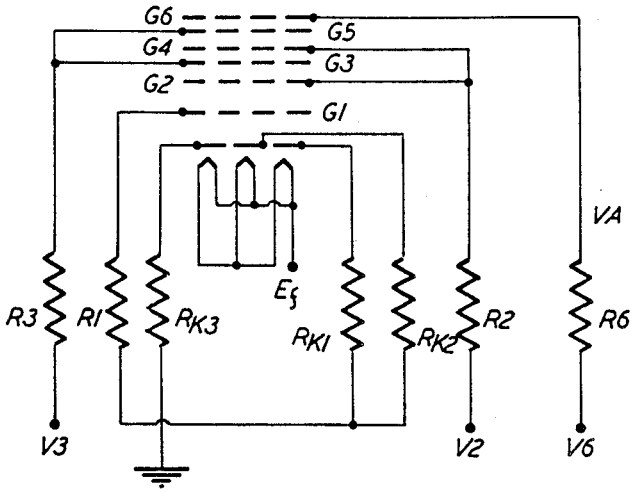
FIG. 4 is a schematic circuit diagram of an arrangement for achieving a weak, defocused electron beam from an electron gun of the type shown in FIG. 3.

FIG. 4 shows one arrangement for obtaining a weak, defocused electron beam from a quadripotential gun of the type shown in FIG. 3, in which a filament voltage $E_f$ of about 8 volts is applied to each cathode filament, a second potential V2 of about 305 volts is applied to the G2 and G4 electrodes, while a third potential V3 of about 400 volts, is applied to the G3 and G5 electrodes. Resistors R2 and R3, having values of about 15 and 30 kilohms, respectively, are included to limit the dissipation to each grid and provide the desired resulting grid potentials. Finally, a potential V6 of about 25 kilovolts is applied ahead of Resistor R6, having a value of about 20 kilohms, to the G6 anode. Due to the current drawn from the cathodes to the anode, a potential drop occurs across R6, resulting in a potential at the anode VA of about 7 kilovolts.

The cathodes, K1–3, and the G1 grid are grounded. Resistances RK1–3 of about 2.7 kilohms each between the cathodes and ground serve to limit cathode current, while a much smaller Resistance R2, for example, about 250 ohms, between G1 and ground, serves to protect the cathodes against G1 grid to cathode shorts.

Such an arrangement results in a weak, defocused beam having a spot size at the screen of about five to six inches in diameter.

A similar arrangement can be used for a bipotential electron gun, except that V2 is applied only to G2, and V3 is applied only to G3.

Figure 5:
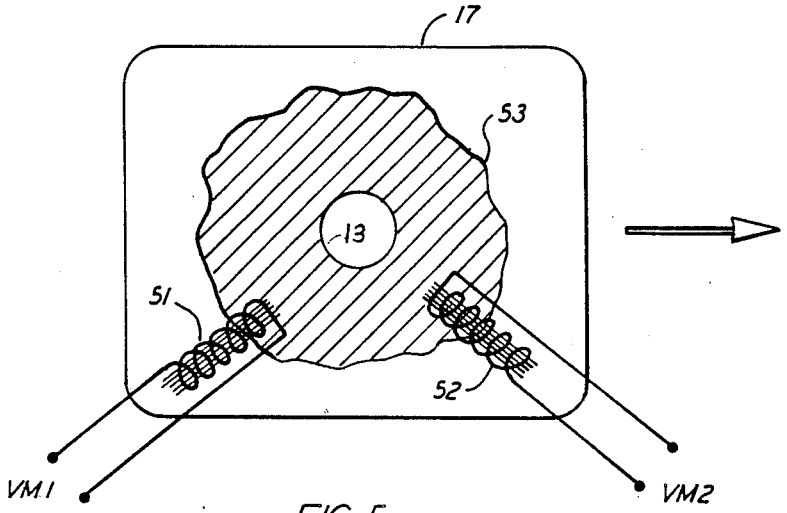
FIG. 5 is a schematic diagram indicating the location of two electromagnets relative to a cathode ray tube viewing panel, and the area scanned by the weak beam of the invention.

The weak beam is scanned by deflection in response to an oscillating magnetic field, such as is produced by juxtaposing two or more electromagnets having different varying magnetic fields. Such an arrangement is shown in FIG. 5, in which electromagnets 51 and 52 are positioned at opposite (lower) corner regions of viewing panel 17. Potentials VM1 and VM2 are applied to electromagnets 51 and 52, respectively. By way of example, such potentials are both about 70 to 80 volt, 60 hertz A.C., but VM1 and VM2 are 90 degrees out of phase. In a mass production arrangement in which tubes index along a process line past the electromagnets 51 and 52, in the direction of the arrow, the beam "scans" the mask and screen in an irregular circular motion, within a central area 53.

In another scanning arrangement, changing the VM1 or VM2 frequency from 60 to 120 hertz and having VM1 and VM2 in phase will result in an irregular "figure eight" scanning pattern. Other arrangements will become apparent to those skilled in the art.

The duration of scanning is dependent upon the time available, longer times in general being more beneficial. However, a minimum time of about 1.5 minutes is necessary to obtain a beneficial effect, with about 2 to 4 minutes being preferred.

It is a standard practice in the manufacture of cathode ray tubes to subject the cathodes and lower grid elements of the electron gun to an aging treatment subsequent to exhausting, baking, sealing and getter flashing the tube. Such aging takes place immediately after the cathodes are activated.

While both weak beam scanning and aging dissociate hydrocarbons, weak beam scanning is not intended to replace aging, since aging primarily "conditions" the surfaces of the adjacent grid elements, that is, heats the grids to remove particles, adsorbed gases and other residue which are potential sources of cathode contamination.

Typical prior art activation and aging schedules and the improved G3 aging schedule referred to above, as well as arrangements for achieving them are described in the above-referenced allowed patent application, Ser. No. 145,637, filed Jan. 11, 1988.

Briefly, with regard to the improved aging, it is necessary to maintain the G3 potential within a critical range during aging, high enough to provide effective gas dissociation and conditioning, but low enough to provide a barrier to the deposition of carbon on the cathodes. In this regard, it has been determined that the G3 potential should be at least 100 volts, and at least 50 volts below the G2 potential, and preferably at least 150 volts and at least 100 volts below the G2 potential.

Weak beam scanning, when practiced in combination with aging, has been found to result in reduced incidences of dark center cathodes, and reduced hydrocarbons and other residual gases, below the levels achieved by aging alone, including the improved aging referred to above.

Weak beam scanning is preferably carried out prior to aging and after cathode activation, so that hydrocarbons and adsorbed gases can be reduced, thereby enabling more effective aging with less incidence of dark center cathode.

In order to illustrate some of the advantages of the invention, the following examples are presented.

EXAMPLE I

Two sets ("control" and "test") of 19V mini neck color CRTs having quadripotential focus electron guns of the type shown in FIG. 3, and having operating anode potentials of 25KV, were processed in the conventional manner, such processing including an aging step in which the potentials at the G1, G2 and G3 electrodes were approximately 16, 200 and 130 volts, respectively. The processing was substantially identical for both sets, except that the test set was subjected to weak beam scanning prior to aging. Scanning was achieved by locating two electromagnets near opposite lower corners of the tubes' viewing panels, as shown in FIG. 5. Scanning conditions were as follows:

$K_1$, $G_1$ grounded
Ef=8.5 volts
V2=120 volts
V3=450 volts
VA=6,000 volts
VM1=75 volts, 60 hertz
VM2=75 volts, 60 hertz
VM1 and VM2 90° out of phase
Time=1½ minutes After processing, residual gas was measured as current from the cathode, and each of the cathodes (red, green and blue) were visually inspected for dark center cathode. Results are shown below in Tables I (control) and II (test), where acceptable cathodes are indicated as "OK" and rejectable cathodes are "R".

TABLE I

| Tube No. | Cathode R | Cathode G | Cathode B | Gas (Microamps) | |
|---|---|---|---|---|---|
| 1 | R | R | R | 0.15 | Average Gas |
| 2 | R | R | R | 0.08 | 0.056 |

TABLE I-continued

| Tube No. | Cathode R | Cathode G | Cathode B | Gas (Microamps) |
|---|---|---|---|---|
| 3 | "FAIR" | | | 0.05 |
| 4 | R | R | R | 0.05 |
| 5 | R | R | R | 0.05 |
| 6 | R | R | R | 0.07 |
| 7 | R | R | R | 0.04 |
| 8 | R | R | R | 0.09 |
| 9 | R | R | R | 0.05 |
| 10 | R | R | R | 0.03 |
| 11 | R | R | R | 0.04 |
| 12 | R | R | R | 0.04 |
| 13 | R | R | R | 0.05 |
| 14 | R | R | R | 0.05 |
| 15 | R | R | R | 0.03 |
| 16 | R | R | R | 0.03 |

TABLE II

| | | | | | |
|---|---|---|---|---|---|
| 1 | OK | OK | OK | 0.01 | Average Gas |
| 2 | OK | OK | OK | 0.01 | 0.012 |
| 3 | OK | OK | OK | 0.01 | |
| 4 | OK | OK | OK | 0.01 | |
| 5 | OK | OK | OK | 0.02 | |
| 6 | OK | OK | OK | 0.01 | |
| 7 | OK | OK | OK | 0.01 | |
| 8 | OK | OK | OK | 0.01 | |
| 9 | OK | OK | OK | 0.01 | |
| 10 | R | R | R | 0.01 | |
| 11 | OK | OK | OK | 0.01 | |
| 12 | OK | OK | OK | 0.02 | |

EXAMPLE II

Two more sets of 19V mini neck tubes were processed as described in Example I except that the potentials at the G1, G2 and G3 electrodes during aging were approximately 20, 225 and 125 volts, respectively. Cathodes were visually inspected for dark centers. Of 26 tubes in the control set, 23 tubes were OK, while the remaining 3 were rejects. Of 22 tubes in the test set, all 22 tubes were OK.

EXAMPLE III

Two more sets of 19V mini neck tubes were processed as described in Example I, except that the potentials at the G1, G2 and G3 electrodes during aging were approximately 12, 230 and 150 volts, respectively. Cathodes were visually inspected for dark centers. Of 351 tubes in the control set, 9 tubes were rejects, while the remaining 342 were OK. Of 365 tubes in the test set, 2 tubes were rejects, while the remaining 363 were OK. Thus, scanning reduced the rejects to 0.55 percent in the test set, as compared with 2.56 percent in the control group.

EXAMPLE IV

Three sets of 25V color cathode ray tubes having bipotential focus electron guns of the type shown in FIG. 2, and having operating anode potentials of 27KV, were processed as described in Example I, except that the anode potentials VA were 0KV for the first set, 4KV for the second set, and 6KV for the third set. After processing, residual gas was measured as in Example I, and cathode emission was measured under zero bias. Results are shown below in Table III, as average values in micro amps (ua).

TABLE III

| VA (KV) | Gas (ua) | Red Gun Emission (ua) | Green Gun Emission (ua) | Blue Gun Emission (ua) |
|---|---|---|---|---|
| None | 0.057 | 3440 | 3342 | 3368 |
| 4 KV | 0.028 | 3354 | 3298 | 3328 |
| 6 KV | 0.015 | 3260 | 3077 | 3216 |

The data indicates the effect of anode potential on residual gas and emission. It can be noted that at 4KV and 6KV anode potential, significant reductions in gas level result, but with a much smaller decrease in cathode emission at 4KV than at 6KV. This is attributed to the reduction in gas ion bombardment of the cathode coating.

We claim:

1. A method of processing a color cathode ray tube comprising scanning at least the central portions of the mask and the screen of the tube with a weak, defocused electron beam from the tube's electron gun, produced by impressing a voltage of from about 15 to 22 percent of the operating voltage on the anode of the electron gun, which scanning is carried out after exhausting, baking, sealing and getter flashing of the tube.

2. The method of claim 1 in which scanning of the beam is achieved by impressing a fluctuating magnetic field on the beam to cause deflection of the beam in response to the field.

3. The method of claim 2 in which the fluctuating magnetic field is produced by impressing A.C. signals on at least first and second externally placed electromagnets in the vicinity of the tube's envelope.

4. The method of claim 3 in which the A.C. signals have the same frequency and are at least 90 degrees out of phase with respect to each other.

5. The method of claim 4 in which the signals each have a frequency of about 60 cycles and a potential of about 100–120 volts.

6. The method of claim 3 in which the A.C. signals have different frequencies.

7. The method of claim 6 in which the signals each have a potential of about 100–120 volts, the first signal has a frequency of 60 cycles and the second signal has a frequency of about 120 cycles per second.

8. The method of claim 1 in which the color cathode ray tube has an operating anode voltage of about 25 to 27 kilovolts, and the weak, defocused electron beam is produced by impressing a voltage of from about 7–10 volts on the cathode filaments of the electron gun, impressing a voltage of about 4–6 kilovolts on the anode of the electron gun and impressing voltages of from about 200–500 volts on each of the G2 and G3 grid electrodes, respectively.

9. The method of claim 8 in which the cathodes and the G1 grid are grounded.

10. The method of claim 9 in which the spot size of the weak, defocused electron beam at the screen is about 5–10 inches.

11. The method of claim 10 in which scanning is carried out prior to aging.

12. The method of claim 11 in which the G3 electrode is included in aging.

13. The method of claim 12 in which the voltage on the G3 electrode is lower than the voltage on the G2 electrode during aging.

* * * * *